United States Patent [19]

Graham

[11] 3,991,520

[45] Nov. 16, 1976

[54] APPLIANCE DOOR OPENING DEVICE

[75] Inventor: Dale Wells Graham, Benton Harbor, Mich.

[73] Assignee: Whirlpool Corporation, Benton Harbor, Mich.

[22] Filed: Dec. 16, 1974

[21] Appl. No.: 533,178

[52] U.S. Cl. ..... 49/276; 49/278; 126/192; 126/197; 312/319; 220/264

[51] Int. Cl.[2] ..... E05F 11/54

[58] Field of Search ..... 49/276–279; 292/DIG. 72, 17; 126/192, 197; 312/319; 220/263, 264, 335

[56] References Cited

UNITED STATES PATENTS

| | | | |
|---|---|---|---|
| 2,982,540 | 5/1961 | Eppley et al. | 49/277 |
| 3,396,489 | 8/1968 | Cirone | 49/276 |

FOREIGN PATENTS OR APPLICATIONS

| | | | |
|---|---|---|---|
| 872,129 | 6/1971 | Canada | 292/17 |
| 1,188,260 | 4/1970 | United Kingdom | 49/276 |

*Primary Examiner*—Kenneth Downey
*Attorney, Agent, or Firm*—Hill, Gross, Simpson, Van Santen, Steadman, Chiara & Simpson

[57] ABSTRACT

A push to open door opening assembly for appliance doors including a single molded opening piece positioned between front and back panels of a substantially hollow door with a pushbutton section projecting through the front panel and an actuator ram projecting through the back panel. A fulcrum point is provided on the molded piece and an integral spring maintains the fulcrum against the front panel and the pushbutton projecting through the front panel. Actuation of the pushbutton pivots the device around the fulcrum against the spring to force the actuator ram from the rear panel into contact with an appliance cabinet wall thereby biasing the door away from the cabinet wall and overcoming a releasable closure device which maintains the door in a closed position.

7 Claims, 7 Drawing Figures

APPLIANCE DOOR OPENING DEVICE

BACKGROUND OF THE INVENTION

1. Field of the Invention 1. invention relates to appliances and more particularly to an appliance door opening device.

2. Prior Art

Appliances, such as for example, laundry appliances, and more particularly, clothes dryers, have access openings thereto. These access openings are normally closed by a hinged door. The door may be maintained in a closed position by means of a latch mechanism coating with the door and the appliance cabinet. Such latch mechanisms have often been of the type which can be overcome by the application of a separating force tending to pull the door away from the cabinet. Specific examples of such latch devices include spring latches, friction latches and magnetic latches.

In order to provide a force for overcoming the latch, the prior art has relied upon a number of devices including simple door handles which can be grasped to pull the door away, push buttons which trip pivoted levers to force a door carried projection out of a spring latch (see, for example U.S. Pat. No. 2,185,161 to Tinnerman), and hinged multiple port release assemblies which apply pressure between a movable door-carried abutment and the cabinet wall. (See, for example, U.S. Pat. No. 2,982,540 to D.F. Eppley et al).

Such prior art devices either provide no mechanical advantage or consist of a large number of parts which can become separated or broken requiring repair and which are expensive and time consuming to assemble during manufacture. It would therefore be an advance in the art to provide a door release mechanism which is inexpensive, consists of a few parts, is easy to install, and which provides a mechanical advantage.

SUMMARY OF THE INVENTION

My invention provides a door opening assembly for appliances and will hereinafter be described in connection with a laundry appliance, and in particular, a clothes dryer. The device makes use of a force releasable latch which may be either of the spring, friction or magnetic type. By "force releasable latch", I mean that class of closure devices which can be opened by the simple application of a undirectional force tending to seperate the separatable parts of the device. The term is not limited to the spring latch shown herein. The force necessary to release the latch is applied by a simple pushbutton which projects through an aperture in the front of the appliance door. The pushbutton is formed as part of a single molded unit which has the pushbutton formed as one end of an arm member having a fulcrum at the other end. Intermediate the fulcrum and the pushbutton, on the opposite side of the arm from the pushbutton, is a ram. The arm has an integrally molded spring projecting away from the arm on the ram side. The unit is assembled interiorly of a substantially hollow door between a front panel and a back panel with the pushbutton projecting through an aperture in the front panel and the ram projecting through an aperture in the back panel. The ram is dimensioned with respect to the door and cabinet to be capable of spanning the distance between the back panel of the door an a wall of the cabinet when the pushbutton is pressed against the spring force. The ram then acts against the cabinet wall to urge the arm, and therefore the door, away from the cabinet wall. In this manner, I have provided a single piece or unitary opening device which can be inexpensively manufactured by molding, which is simple to install and operate and which is aesthetically pleasing.

It is therefore an object of this invention to provide an improved opening device for appliances.

It is another object of this invention to provide a pushbutton opening device for appliances.

It is yet another more specific object of this invention to provide a pushbutton opening device for appliances constructed of a single moldable piece.

It is another and more specific object of this invention to provide an opening assembly for appliance doors including a force releasable latch and a pushbutton device for applying the force necessary to release the latch upon actuation of the pushbutton, the device being constructed of a single piece and received interiorly of a hollow door with a pushbutton projecting through the front panel of the door.

It is yet another and more specific object of this invention to provide a door closure and opening assembly for appliances including a force releasable latch capable of maintaining the door in a closed position and an opening device received interiorly of the door consisting of a single molded piece having a pushbutton projecting from the front of the door and a ram projecting from the back of the door and positioned to engage a wall of the cabinet upon actuation of the pushbutton, with an integral spring urging the pushbutton through the front of the door and maintaining the ram in a withdrawn position, the device being provided with a mechanical lever advantage.

BRIEF DESCRIPTION OF THE DRAWINGS

Other objects, features and advantages of the invention will be readily apparent from the following description of a preferred embodiment thereof, taken in conjunction wth the accompanying drawings, although variations and modifications may be effected without departing from the spirit and scope of the novel concepts of the disclosure and in which.

DESCRIPTION OF THE PREFERRED EMBODIMENT

Figure 1:
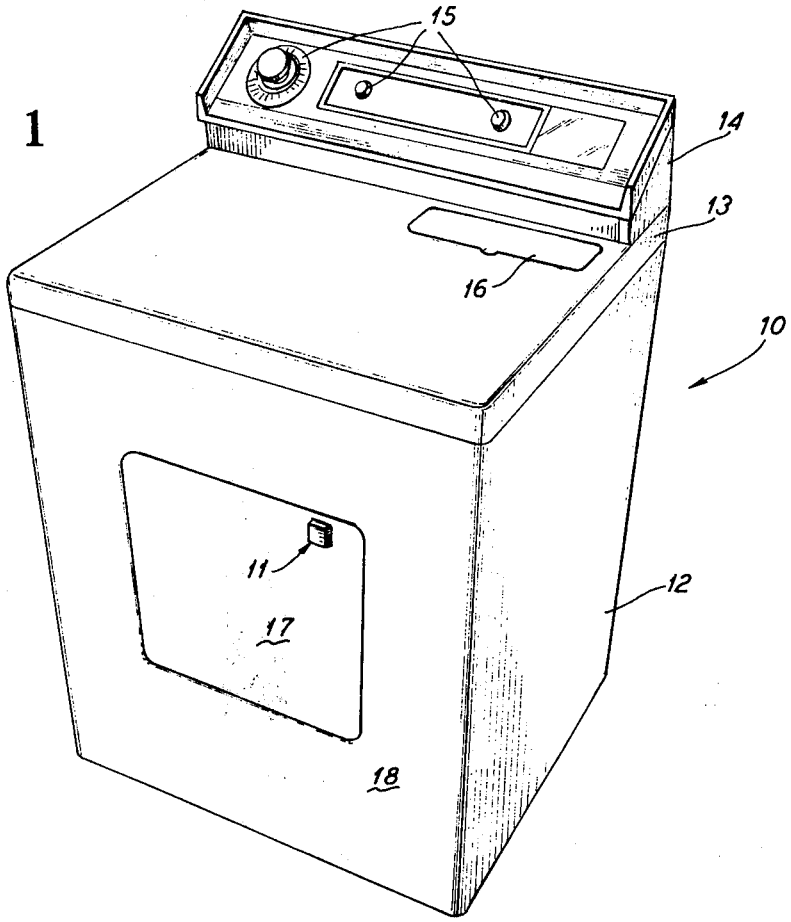
FIG. 1 is a perspective view of a laundry appliance equipped with the opening device of this invention.
Figure 2:
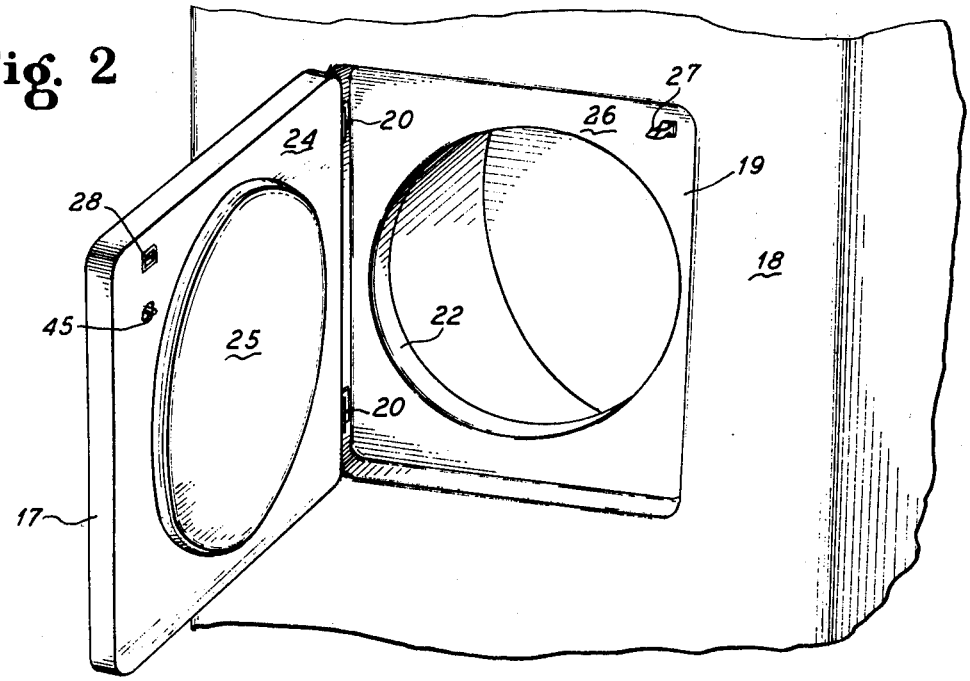
FIG. 2 is a fragmentary perspective view of the appliance of FIG. 1 illustrating the door in its opened position.
Figure 3:
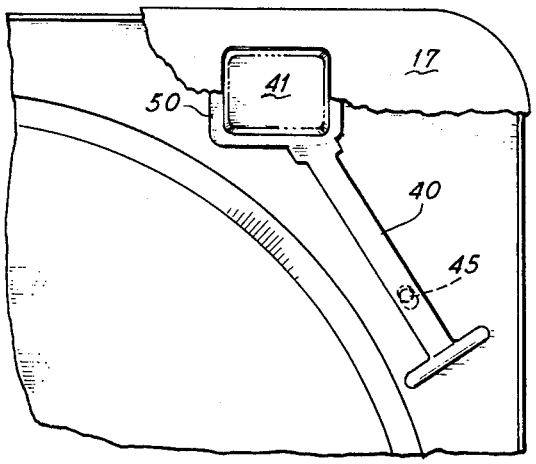
FIG. 3 is a fragmentary plan view of the door of the appliance of FIG. 2 from the front thereof with portions of the front panel of the door broken away to show underlying portions.
Figure 4:
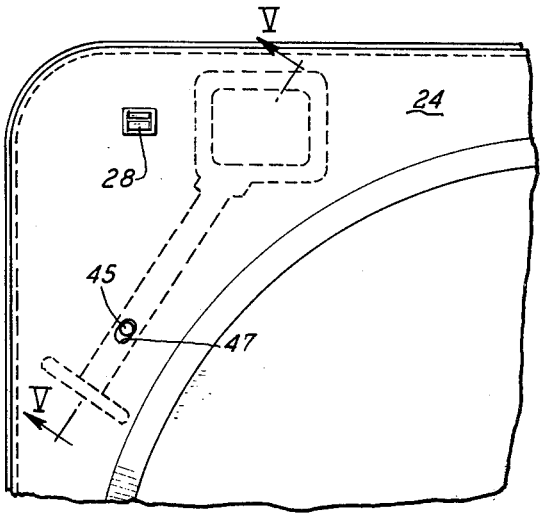
FIG. 4 is a view similar to FIG. 3, however, illustrating the door from the back thereof with underlying portions illustrated by broken lines.

FIG. 1 illustrates a laundry appliance, particularly a clothes dryer 10 equipped with the opening device of this invention generally indicated at 11. It is to be understood that although I have chosen to describe my invention in connection with a laundry appliance that this invention is usable with other devices having doors. The dryer 10 has a cabinet body 12 with four sides and a top 13. A console 14 is positioned on the top and has controls 15 for controlling the drying cycle of the appliance. A lint filter opening 16 is provided through the top and access door 17 is provided in a front wall 18 of the cabinet 12. As shown in FIG. 2, the front wall 18 has a substantially centrally disposed recess 19 into which the door 17 fits. The door is attached to the cabinet body by hinges 20 with the door 17 thus being pivotally attached to the cabinet. Centrally disposed of the recess 19 is an access opening 22 to the interior of the clothes dryer. The door 17 has a back panel or wall 24 having a substantially centrally disposed raised portion 25 thereon which is dimensioned to project into the opening 22 when the door is closed.

Figure 5:
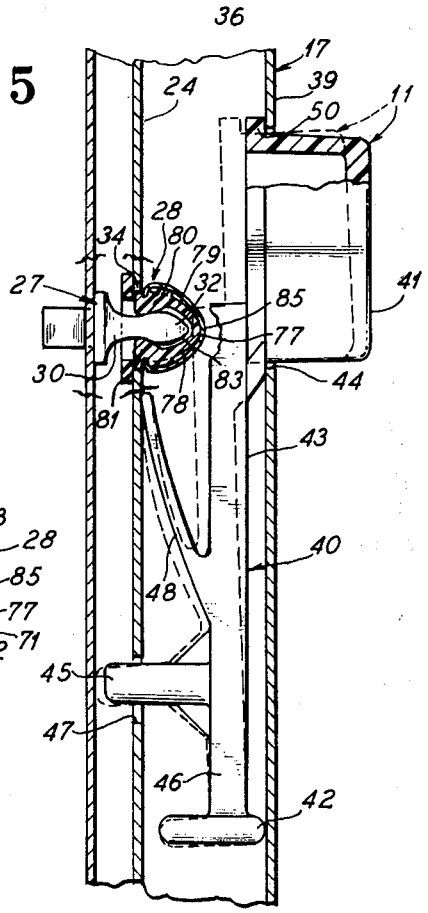
FIG. 5 is a sectional view of the door of FIG. 4 taken along the lines V—V thereof.
Figure 7:
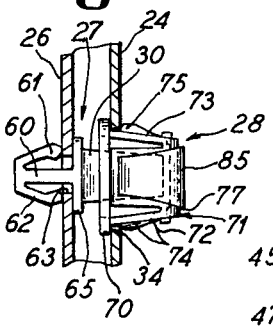
FIG. 7 is a fragmentary cross-sectional view of portions of the door and cabinet wall illustrting a force releasable latch shown rotated 90° from FIGS. 5 and 6.

The recess 19 has a wall 26 which has extension means here shown as a closure latch portion 27 projecting therefrom. The closure latch portion 27 of the force releasable latch assembly is, in the embodiment illustrated, in the form of a spear which extends into a force releasable latch part 28 when the door is closed. As is best shown in FIGS. 5 and 7, the spear shaped closure portion 27 has a shaft portion 30 affixed to the wall 26 and an enlarged free head 32 spaced from the wall 26.

In the embodiment illustrated, the shaft portion 30 and the free head 32 may be elongated in cross-section with the free head 32 having a larger dimension than the shaft portion 30. As best shown in FIG. 7, a T-shaped locking portion 60 is formed as the end of the closure latch portion 27 remote from the free head 32 and includes spring collapsible legs 61 and 62 having a free state distance therebetween greater than an opening 63 in the wall 26. However, the legs 61 and 62 are collapsible towards one another to a compressed dimension less than the opening 63 whereby the portion 60 can be inserted through the opening 63 with the legs 61 and 62 locking the closure latch portion 27 to the wall 26 by expansion to their free state after passing through the opening 63. An enlarged abutment portion 65 is provided to lie on the opposite side of the wall 26 from the portion 60 with the clearance between the ends of the legs 61, 62 and the enlarged abutment portion 65 being substantially equal to the thickness of the wall 26.

The force releasable latch part 28, in the embodiment illustrated, comprises a single molded piece which has an enlarged abutment surface 70 lying against one side of the back wall 24 of the door and a holding portion 71 extending through an aperture 34 in the back wall 24, into the interior 36 of the door. The holding portion consists of end walls 72 and 73 formed with abutments 74 and 75 thereon which are spaced from the abutment 70 by a distance approximately equal to the thickness of the back wall 24. The end walls 72, 73 are substantially rigid but are slightly compressible towards one another so that the holding portion 71 can be inserted through the opening 34 to a point where the abutments 74 and 75 have passed through the opening. Thereafter the end walls will resume their normal state and lock the latch part 28 in the opening by entrapping a portion of the back wall 24 adjacent the aperture 34 between the abutments 74 and 75 and the abutment surface 70.

The holding portion 71 also includes a back wall 77 extending between the end walls 72 and 73. Two spring actuated legs 78 and 79 project away from the back wall 77 towards the abutment 70 and are integral with the back wall but are unconnected to the end walls 72 and 73. The legs 78 and 79 terminate in headed portions 89 and 81 which are spaced from one another by a distance less than the dimension of the free head 32. Between the headed portions 80 and 81 and the back wall 77 is a cavity 83 having a dimension greater than the free head. When the door is closed, the free head will be thrust between the headed portions 80 and 81 spreading them apart a distance sufficient to let the free head pass into the cavity 83. A U-shaped spring member 85 urges the headed portions 80 and 81 towards one another into embracement with the shaft portion 30. Thus, it will be seen that in order to open the latch it is only necessary to provide a sufficient force tending to separate closure portion 27 from the latch part 28 by overcoming the spring force of spring 85 and allowing the headed portions 80 and 81 to separate sufficient to pull the free head 32 from the holding portion 71. This type of latch assembly is herein referred to as a spring latch and will assure that the door of the appliance will remain closed with the head 32 being retained in the holding portion by action of the spring 85 until a sufficient opening force has been applied to overcome the spring.

The door opening means or opening device 11 of this invention is designed to apply a force sufficient to overcome the retaining force of the spring 85. The opening device 11 is primarily received in the hollow space 36 between the back wall 24 and a front panel or wall 39 of the door 17, and consists of an elongated arm 40 having an actuator here shown as a pushbutton headed portion 41 at one end and a fulcrum 42 at the other end for providing a pivot point. The pushbutton portion 41 is illustrated as being rèctangular and projects from a front side 43 of the arm through an aperture 44 in the front wall 39. A ram projection 45 extends from the back side 46 of the arm and is positioned intermediate the fulcrum 42 and the pushbutton 41. The ram extends through an aperture 47 in the back wall 24 of the door 17. An integrally formed spring member 48 also projects from the back side 46 and contacts the inside face of the door back wall 24. The spring is effective to maintain the pushbutton 41 fully projecting through the opening 44. It is to be noted that the pushbutton is formed with a flange 50 therearound having a dimension greater than the aperture 44 so that the pushbutton 41 can only be urged by the spring 48 to a fully projected position where the flange 50 bottoms on the wall 39.

The ram 45 is dimensioned such that when the pushbutton 41 is in its fully projected position as illustrated by the solid lines in FIG. 5 the ram will not contact the wall 26 of the cabinet when the door is closed. However when the pushbutton 41 has been depressed against the action of the spring 48, the ram 45 will contact the back wall 26 as the arm 40 pivots around the fulcrum 42. After contact between the ram and the back wall 26 further force applied to depress the pushbutton 41 will cause the ram 45 to press against the wall 26 of the cabinet with an increasing amount of force until the retention pressure of the spring 85 is exceeded and the spear head 32 is released thereby allowing the door to open. Because the ram 45 is placed between the pushbutton and the fulcurm 42, a mechanical advantage is provided.

In particular embodiment of this invention, the release pressure of the spring 85 may require a pressure of from 4–8pounds to be applied by the ram to the back wall 26. It has been found that a 1κ2 pound spring force generated by the spring 48 will be sufficient to maintain the pushbutton in its fully projected position thereby maintaining the door opening device in place in the door. In a preferred embodiment, the ram 45 is located with respect to the pushbutton 41 and the fulcrum point 42 to provide a 4 to 1 mechanical advantage. Thus the ram pressure of from 4–8 pounds can be provided by a push pressure against the pushbutton 41 of from 1–2 pounds plus the pressure necessary to overcome the 1½2 pound pressure of spring 48.

Figure 6:
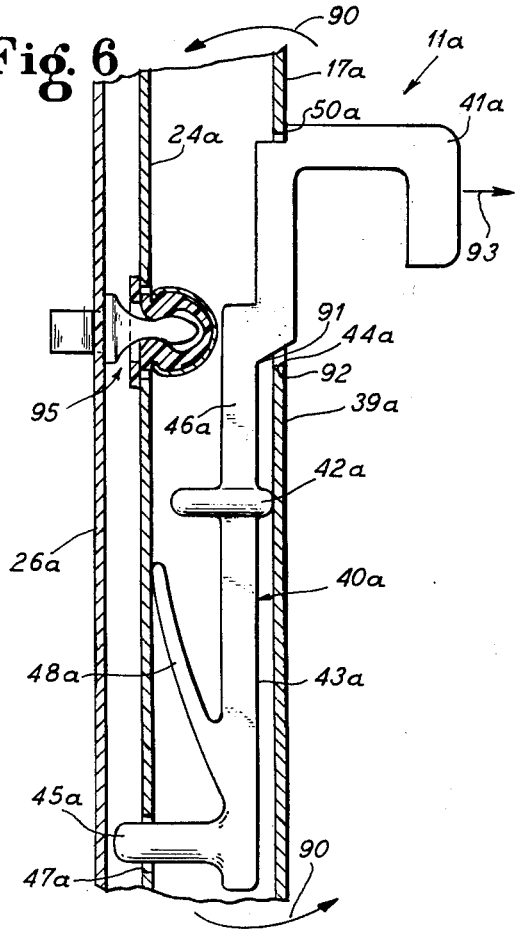
FIG. 6 is a view similar to FIG. 5 illustrating a different positioning of the closure latch.

FIG. 6 shows a variation of the embodiment of the invention heretofore described. In FIG. 6 the opening device 11*a* fits inside the substantially hollow door 17*a* and includes an arm 40*a* with front and back sides 43*a* and 46*a* respectively. A ram portion 45*a* is formed on one end of the arm to project through an aperture 47*a* in the back wall 24*a* of the door, and an actuator in the form of a handle 41*a* is formed on the other end of the arm to extend through an aperture 44*a* in the front wall 39*a* of the door. A fulcrum 42*a* is formed on the arm intermediate the actuator and the ram for contacting the inside surface of the front wall 39*a;* and a spring member 48*a*, integral with the arm, is located between the ram and the fulcrum. The spring member extends from back side 46*a* of the arm and contacts the inside surface of back wall 24*a* to provide a counterclockwise bias to the opening device about its fulcrum as indicated by the arrows 90. A shoulder portion 50*a* on the actuator contacts the front wall 39*a* adjacent the aperture 44*a* and acts as a stop to limit travel of the opening device in one direction about its fulcrum, while a contact surface 91 on the front side 43*a* of the arm will contact front wall 39*a* at 92 to limit travel of the opening device in the other direction. It will be readily seen that the bias from the integrally-formed spring member 48*a* will tend to hold the opening device firmly within the door with the shoulder portion 50*a* contacting the front wall 39*a* so as to eliminate the possibility of looseness and resulting noise or chatter of the opening device within the door.

To open the door utilizing this form of the invention the operator grasps the actuator or handle 41*a* and applies a pulling force in the direction indicated by the arrow 93. The causes the handle to move away from the door in the direction of arrow 93 as the opening device pivots about its fulcrum, and the ram moves outwardly through aperture 47*a* in the direction of cabinet wall 26*a*. A sufficient pulling force on the handle 41*a* will cause the ram to contact wall 26*a* and force the door away from the cabinet overcoming and unlatching the force releasable latch shown in FIG. 6 as spring latch 95 in the same manner as described with respect to the earlier embodiment of the invention herein.

It should be appreciated that in the embodiment illustrated in FIGS. 6 and 7, the opening device is maintained in position between the front 39 and back 24 walls of the hollow door solely by action of the spring 48 which maintains the pushbutton 41 projecting from the opening 44 which is dimensioned to closely receive the projecting portion of the pushbutton. The ram is thus maintained in a partially projecting state. The aperture 47 through the back wall 24 is dimensioned significantly larger than the ram 45 in order to allow the ram to pivot as illustrated by the broken lines of FIG. 5. In this manner, when the door is closed, all that will be seen from the outside is the projecting portion of the pushbutton. Conversely, when the door is open, all that will be seen from the inside will be the projecting portion of the ram 45 extending from its slightly larger aperture 47 and the opening 34 receiving the force releasable latch part 28.

It can therefore be seen from the above that my invention provides a simple opening device for appliance doors which provides the force necessary to overcome a force releasable latch. The opening device consists solely of a one piece molded device having a pushbutton portion projecting from a front wall of the door and a ram portion projecting from a rear wall of the door with the remainder of the device received between the front and rear walls of the substantially hollow appliance door. The device is preferably molded from plastic and includes an integral spring and a pivot point which cooperate to urge the pushbutton portion into full projection through the front of the appliance door while providing a mechanical advantage for multiplying the force applied to the pushbutton into an opening force applied by the ram. The fulcrum point is positioned on one end of the molded arm with a pushbutton head positioned on the other end of the molded arm. The ram projects from a back face of the arm opposite the projection of the fulcrum point and the pushbutton. The spring projects from the face intermediate the ram and the pushbutton.

Although the teachings of my invention have herein been discussed with reference to specific theories and embodiments, it is to be understood that these are by way of illustration only and that others may wish to utilize my invention in different designs or applications.

The embodiments of the invention in which an exclusive property of privilege is claimed are defined as follows:

1. A closure and opening device for appliances having a hollow door hinged to a cabinet front comprising: a latch means selecively maintaining a door in a closed position and releasable to allow the door to open, a door opening device for releasing the latch means, said door opening device comprising a single molded plastic piece having a major portion thereof received interiorly of the hollow door, said major portion including an elongated member having a fulcrum point adjacent one end in contact with an interior face of the hollow door and a pushbutton member adjacent the other end of the elongated member, said pushbutton member projecting through an aperture in a front of the door, a ram member projecting from said elongated member intermediate the pushbutton member and the fulcrum, said ram member projecting through an aperture in the back of the door, said ram member having a length sufficient to span the distance between the back of the hollow door and a wall of the cabinet when the door is closed and the pushbutton is depressed, an integral spring projecting from said elongated member opposite the said pushbutton into contact with a back wall of the door biasing the fulcrum agianst the front of the door and the pushbutton into projection from the front of the door, the ram positioned with respect to the pushbutton and the fulcrum to provide a mechanical lever advantage upon depressing the pushbutton to pivot the elongated member about the fulcrum against the spring.

2. The assembly of claim 1 wherein the pushbutton has means associated therewith limiting the amount of projection of the pushbutton from the door.

3. The assembly of claim 2, wherein the pushbutton is rectangular and is received through a rectangular opening in the door whereby twisting of the arm in the door is prevented.

4. An appliance having a cabinet including an access opening, a substantially hollow door including a front and a back panel for closing said access opening, hinge means for hingedly attaching said door to said cabinet for movement between a door closed and a door opened position, and latching means releasably latching said door in said closed position; the improvement comprising:

door opening means positioned in said substantially hollow door between said front and back panels, said door opening means including a one piece member having an actuator section having a portion thereof projecting through an opening in the front door panel, said one piece member having a free pivot point formed as a raised fulcrum portion spaced from the actuator section received interiorly of the door contacting an interior surface of the front door panel, said one piece member having spring means biasing said actuator and said free pivot point against said front door panel, and said one piece member having ram means projecting through said back door panel only for exerting a force against said cabinet in response to a force exerted on said actuator section, said actuator, pivot point, spring means and ram all formed as parts of said one piece member, said one piece member free of attachment to said door except for the projecting of the acutator portion through the front panel and the ram means through the back panel.

5. The improvement of claim 4 wherein the actuator is a pull type actuator with the projecting portion including a grasping surface for pulling the projecting portion further through said opening, the pivot point positioned intermediate the actuator and the ram, and the spring positioned intermediate the pivot point and the ram.

6. The improvement of claim 4 wherein the actuator is a push type actuator with the ram means positioned intermediate the pivot point and the actuator, the pivot point and actuator lying at substantially opposite ends of the one piece member, and the spring positioned intermediate the ram means and the actuator.

7. A closure and opening device for appliances having a hollow door hinged to a cabinet front comprising:

a latch means selectively maintaining a door in a closed position and releasable to allow the door to open, a door opening device for releasing the latch means, said door opening device comprising a single molded plastic piece having a major portion thereof received interiorly of the hollow door, said major portion including an elongated member having a fulcrum point intermediate ends thereof in contact with an interior face of the hollow door and a pull member adjacent one end of the elongated member, said pull member projecting through an aperture in the front of the door, a ram member projecting from said elongated member adjacent an other end of the elongated member, said ram member projecting through an aperture in the back of the door, said ram member having a length sufficient to span the distance between the back of the hollow door and a wall of the cabinet when said door is closed and the pull member is pulled further through the aperture in the front of the door, and an integral spring projecting from said elongated member opposite the said push button into contact with the back wall of the door biasing the fulcrum against the front of the door and urging the pull member into the interior of the door from the front of the door, the ram positioned with respect to the push button and the fulcrum to provide a mechanical lever advantage upon pulling the pull member to pivot the elongated member above the fulcrum against the spring, and means preventing passage of the entirety of the pull member through the aperture into the interior of the door.

* * * * *